US005830089A

United States Patent [19]

Halter et al.

[11] Patent Number: 5,830,089

[45] Date of Patent: Nov. 3, 1998

[54] COLLAPSIBLE SPORTS GOAL

[75] Inventors: Jeffrey T. Halter, Cincinnati; Brian S. Dengler, Middletown, both of Ohio

[73] Assignee: Hasbro, Inc., Pawtucket, R.I.

[21] Appl. No.: 984,262

[22] Filed: Dec. 3, 1997

[51] Int. Cl.[6] ..... A63B 63/00

[52] U.S. Cl. ..... 473/478; 273/400

[58] Field of Search ..... 473/478, 212; 273/398, 400, 396

[56] References Cited

U.S. PATENT DOCUMENTS

| | | | |
|---|---|---|---|
| 331,756 | 12/1885 | Baker | 473/478 |
| 2,144,148 | 1/1939 | Gross . | |
| 4,210,326 | 7/1980 | Booth et al. . | |
| 4,905,996 | 3/1990 | Tallent et al. . | |
| 4,932,657 | 6/1990 | Hailer et al. . | |
| 5,000,461 | 3/1991 | Borazjani | 273/400 X |
| 5,186,469 | 2/1993 | Terris | 473/478 |
| 5,413,328 | 5/1995 | Glancey et al. | 473/478 X |
| 5,413,356 | 5/1995 | Bigelow | 273/400 |
| 5,421,586 | 6/1995 | Amram et al. | 273/400 |
| 5,431,411 | 7/1995 | Padilla | 273/400 X |
| 5,496,040 | 3/1996 | Amburgey et al. | 473/478 |
| 5,533,733 | 7/1996 | Dirnbeck | 273/400 |
| 5,549,304 | 8/1996 | Davis | 273/400 X |
| 5,556,104 | 9/1996 | Guillen, Jr. | 273/400 X |
| 5,566,952 | 10/1996 | Mullin et al. | 273/400 |
| 5,580,064 | 12/1996 | Childers, Jr. | 273/400 |
| 5,655,774 | 8/1997 | Cox | 473/478 |
| 5,681,045 | 10/1997 | Liao | 273/400 |
| 5,695,195 | 12/1997 | John et al. | 273/400 |

*Primary Examiner*—William H. Grieb
*Attorney, Agent, or Firm*—Kurt R. Benson

[57] ABSTRACT

A collapsible sport goal includes a collapsible frame assembly, and a net extended around the collapsible frame assembly. The frame assembly includes a base frame, an inverted U-shaped goal frame, an inverted U-shaped rear frame, and pivoting connector rods connected laterally between center portions of the goal frame and the rear frame. The goal frame includes a center portion and two leg portions which are pivotally attached to a front portion of the base frame such that the goal frame is pivotally movable relative to the base frame. The rear frame includes a center portion and two leg portions which are pivotally attached to a rear portion of the base frame wherein the rear frame is pivotally movable relative to the base frame. The connector rods are pivotally connected at each end thereof between the respective center portions of the goal frame and the rear frame such that the connector rods are pivotally rotatable relative to the goal frame and the rear frame. In use, the frame assembly is movable between an open position wherein the base frame is positioned on a supporting surface, the goal frame extends vertically, the rear frame extends generally upwardly and forwardly and the connector rods extend laterally between the goal frame and the rear frame, and a closed position wherein the goal frame, rear frame and connector rods are substantially coplanar with the base frame. The frame assembly further includes a simple locking mechanism for releasably locking the frame assembly in the open position.

14 Claims, 5 Drawing Sheets

COLLAPSIBLE SPORTS GOAL

BACKGROUND AND SUMMARY OF THE INVENTION

The instant invention relates to children's sporting products and more particularly to a collapsible sports goal for use by children in recreational sports play activities, such as soccer.

Collapsible sports goals for soccer and hockey have heretofore been known in the art. In this regard, the Terris U.S. Pat. No. 5,186,469; Padilla U.S. Pat. No. 5,431,411; and Cox U.S. Pat. No. 5,655,744 represent the closest prior art to the subject invention of which the Applicants are aware. The patent to Terris discloses a folding soccer goal including a U-shaped base frame, and an inverted U-shaped goal frame. The legs of each frame are pivotally connected to each other at their ends so that the goal frame can stand vertically while the base frame is positioned on a supporting surface, or alternatively the goal frame can fold downwardly to a generally coplanar position with the base frame. The soccer goal further includes locking toggle arms which span between the base frame and the goal frame to lock the goal in an open position. The patent to Padilla discloses a combination sports goal and pitch back assembly including an inverted U-shaped goal frame, and a U-shaped base frame. The ends of the base frame are pivotally connected to rearwardly extending feet portions of the goal frame wherein the base frame can be rotated upwardly to form an angled pitch back net The Patent to Cox discloses another folding sports goal including a U-shaped base frame, an inverted U-shaped goal frame, and two connector rods extending angularly between the center portions of the base frame and the goal frame. Both ends of the connector rods are rotatable about the respective center portions of the base frame and goal frame. Accordingly, when the legs of the goal frame are disassembled from their connection with the legs of the base frame, the goal frame and base frame can rotate relative to the ends of the connector rods so that all of the legs of the assembly are generally positioned in a flat coplanar arrangement While the above-noted devices are effective for their intended purposes, it is generally believed that each requires to much manipulation and assembly for proper set up and use by younger children. It is therefore believed that there is a need in the industry for a collapsible sports goal which can more easily be opened and locked in the open position by young children.

In this regard, the instant invention provides a collapsible sports goal comprising a collapsible frame assembly, and a net which is extended around the top, bottom, side and rear areas of collapsible frame assembly. The collapsible frame assembly includes a rectangular base frame, an inverted U-shaped goal frame, an inverted U-shaped rear frame, and pivoting connector rods connected laterally between the center portions of the goal frame and the rear frame.

The base frame includes front, rear, left side and right side frame members connected together by 90° elbow connectors. In use, the base frame is normally positioned in a generally horizontal plane on a supporting surface.

The goal frame includes a center portion and two leg portions which are pivotally attached to the front frame member of the base frame such that the goal frame is pivotally movable relative to the base frame. The rear frame also includes a center portion and two leg portions which are pivotally attached to a rear portion of the base frame wherein the rear frame is pivotally movable relative to the base frame. The goal frame has a width which is less than the width of the base frame, and the rear frame has a width which is less than the width of the goal frame. In this regard, the goal frame and rear frame can be pivoted to coplanar nested positions within the plane defined by the base frame. The connector rods are pivotally connected at each end thereof between the respective center portions of the goal frame and the rear frame such that the connector rods are rotatable relative to the goal frame and the rear frame.

In use, the frame assembly is movable between an open position wherein the base frame is positioned in a generally horizontal plane, the goal frame extends vertically upwardly from the base frame, the rear frame extends generally upwardly and forwardly and the connector rods extend laterally between the goal frame and the rear frame, and a closed position wherein the goal frame, rear frame and connector rods are substantially coplanar with the base frame. The frame assembly further includes simple interlocking detent and notch formations on the connections between the connector rods and rear frame for releasably locking the frame assembly in the open position. The frame assembly still further includes a handle on the center portion of the goal frame for carrying the assembly, and a ramp mounted on the front frame member of the base frame for guiding the ball upwardly over the front frame member and into the goal.

The frame assembly can alternatively be utilized as a kick back net simply by positioning the assembly with the goal frame on the supporting surface so that the base frame extends vertically upwardly. Since the net extends around the bottom surface of the base frame, a vertical netting surface is presented into which a ball can be kicked.

Accordingly, among the objects of the instant invention are: the provision of a collapsible sports goal which does not require any assembly or disassembly for use; the provision of a collapsible sports goal which can be easily opened and closed by a child under the age of 5; the provision of a collapsible sports goal which does not include any sophisticated locking elements; the provision of a collapsible sports goal which collapses into a generally planar configuration for storage in a narrow storage space, such as under a couch or behind a door; and the provision of a collapsible sports goal which can also function as a kick back net without repositioning of any of the structural elements.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
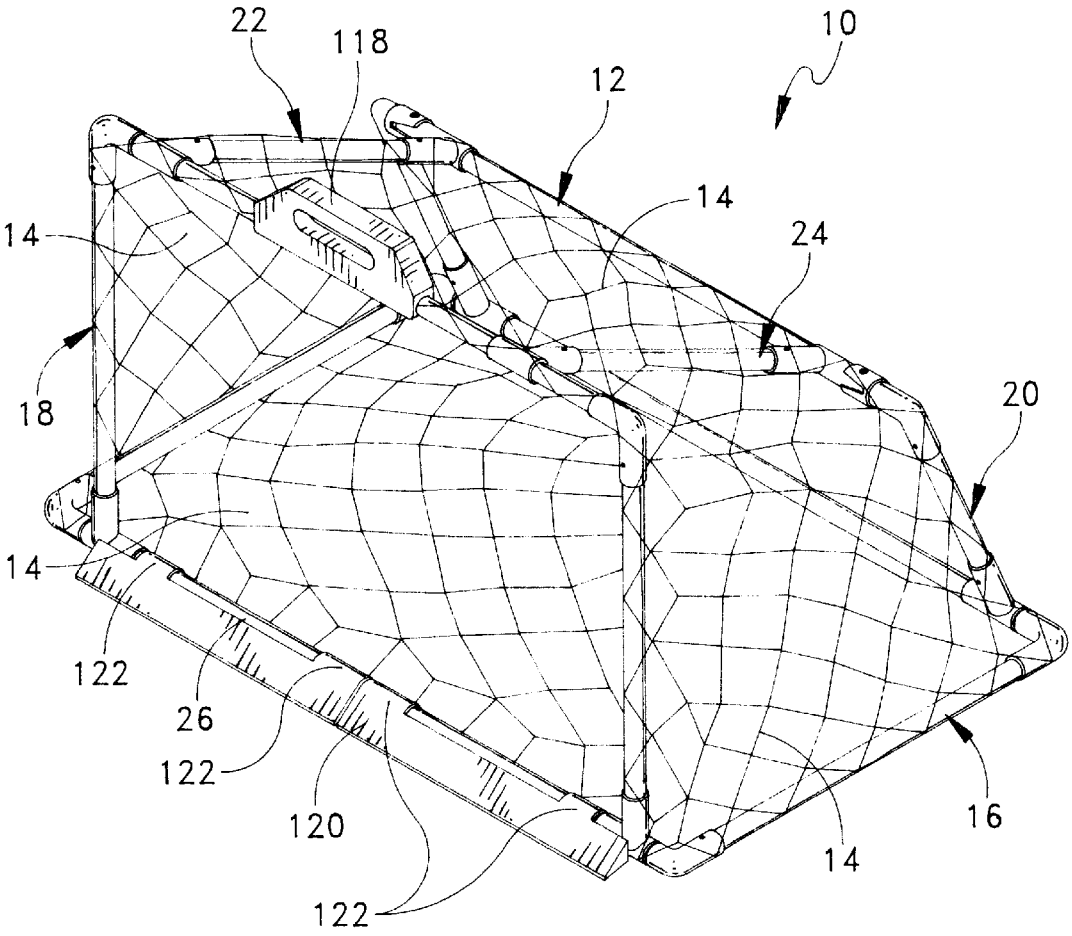
FIG. 1 is a perspective view of the collapsible sports goal of the instant invention.

Referring now to the drawings, the collapsible sports goal of the instant invention is illustrated and generally indicated at 10 in FIGS. 1–9. As will hereinafter be more fully described, the instant collapsible sports goal 10 is designed for use by young children in backyard, or informal sporting activities.

More specifically, the collapsible sports goal 10 comprises a collapsible frame assembly generally indicated at 12, and a nylon mesh net 14 which is extended around the top, bottom, side, and rear areas of the collapsible frame assembly 12.

Figure 3:
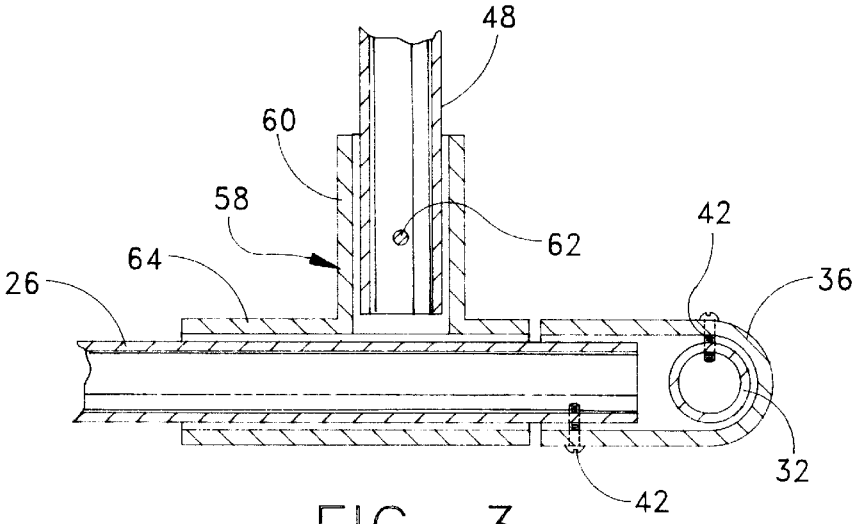
FIG. 3 is a cross-sectional view of one of the connections between the base frame and the goal frame as taken along line 3—3 of FIG. 2.
Figure 4:
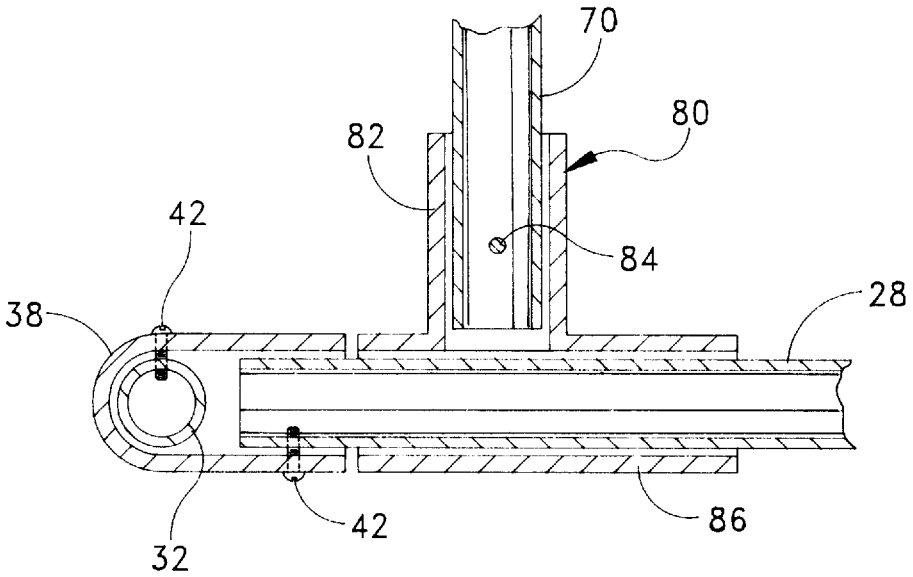
FIG. 4 is a cross-sectional view of one of the connections between the base frame and the rear frame as taken along line 4—4 of FIG. 2.

The collapsible frame assembly 12 includes a rectangular base frame generally indicated at 16, an inverted U-shaped goal frame generally indicated at 18, an inverted U-shaped rear frame generally indicated at 20, and two pivoting connector rods generally indicated at 22, 24 respectively, connected laterally between center portions of the goal frame 18 and the rear frame 20. Unless otherwise stated herein, it is to be understood that each of the structural elements described herein is preferably molded from a lightweight plastic material. Alternatively, the structural elements could be fabricated from metal materials for a heavier, stronger product The base frame 16 includes front, rear, left side and right side tubular frame members 26, 28, 30, and 32 respectively, which are rigidly connected together by four 90° elbow connectors 34, 36, 38, 40 respectively. Referring to FIGS. 3 and 4, the frame members and elbow connectors are rigidly connected together using threaded fasteners 42 which pass through the respective elbow connectors and frame elements. In use, the base frame 16 is normally positioned in a generally horizontal plane on a supporting surface.

Figure 5:
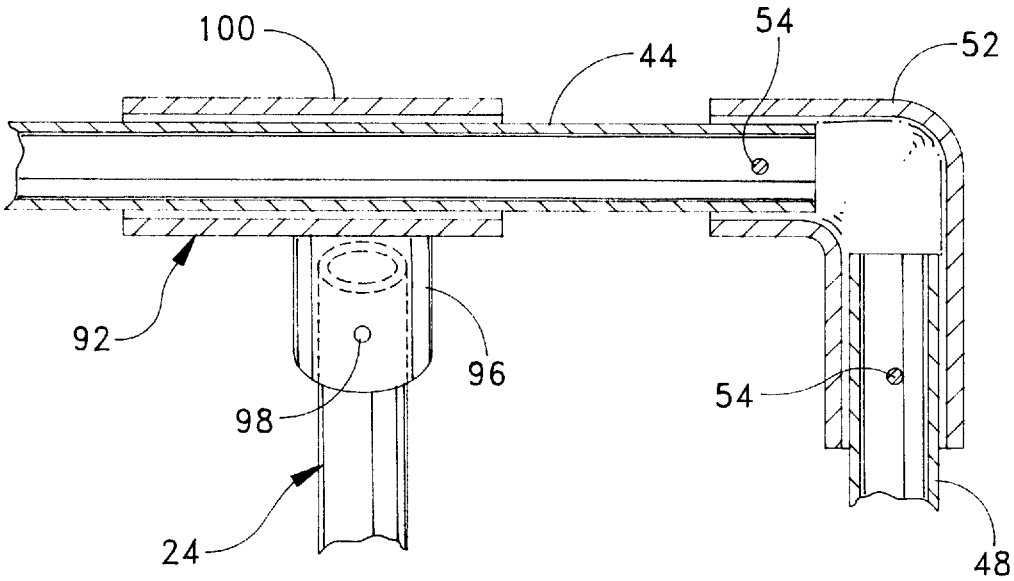
FIG. 5 is a cross-sectional view of one of the connections between the goal frame and connector rod as taken along line 5—5 of FIG. 2.

The goal frame 18 includes a center frame member 44 and two leg members 46, 48 respectively, which depend downwardly from the center frame member 44. Referring to FIG. 5, the upper ends of the leg members 46, 48 are rigidly connected to the center frame member 44 by 90° elbow connectors 50, 52 and threaded fasteners 54. The lower ends of the leg members 46, 48 are pivotally attached to the front frame member 26 of the base frame 16 by means of T-shaped connectors generally indicated at 56, 58 respectively, such that the entire goal frame 18 is pivotally movable relative to the base frame 16. More specifically, referring to FIGS. 2 and 3, the center leg 60 of the T-shaped connector is rigidly attached to the lower end of the leg member 48 by a threaded fastener 62 while the cross leg 64 of the connector 58 is slidably and rotatably received around the front frame member 26 of the base frame 16. The arrangement of the connector 56 is identical. It can therefore be seen that the T-shaped connectors 56, 58 are rotatably movable around the front frame member 26 of the base frame 16 for pivoting movement of the entire goal frame 18 relative to the base frame 16.

Figure 2:
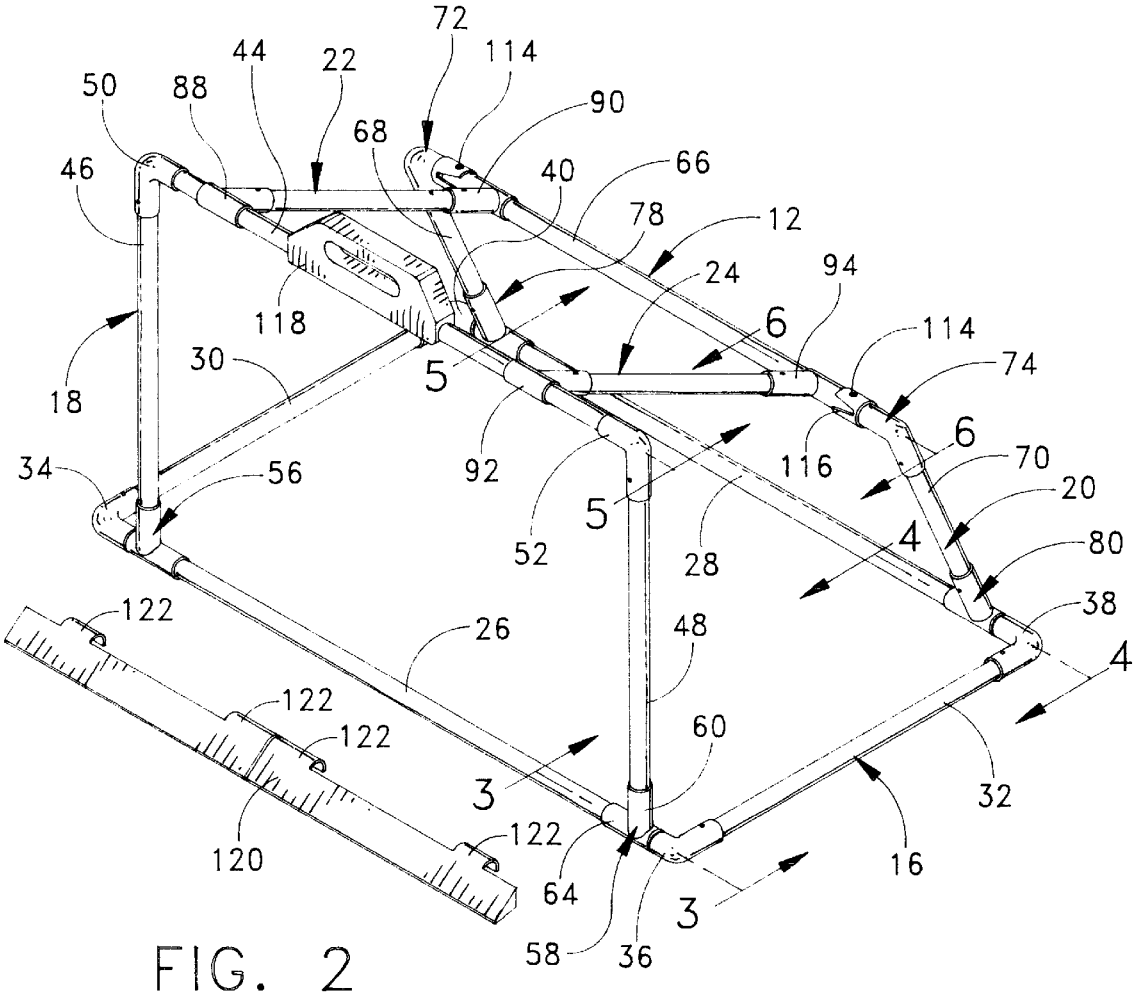
FIG. 2 is an exploded perspective view of the frame assembly of the collapsible sports goal.
Figure 6:
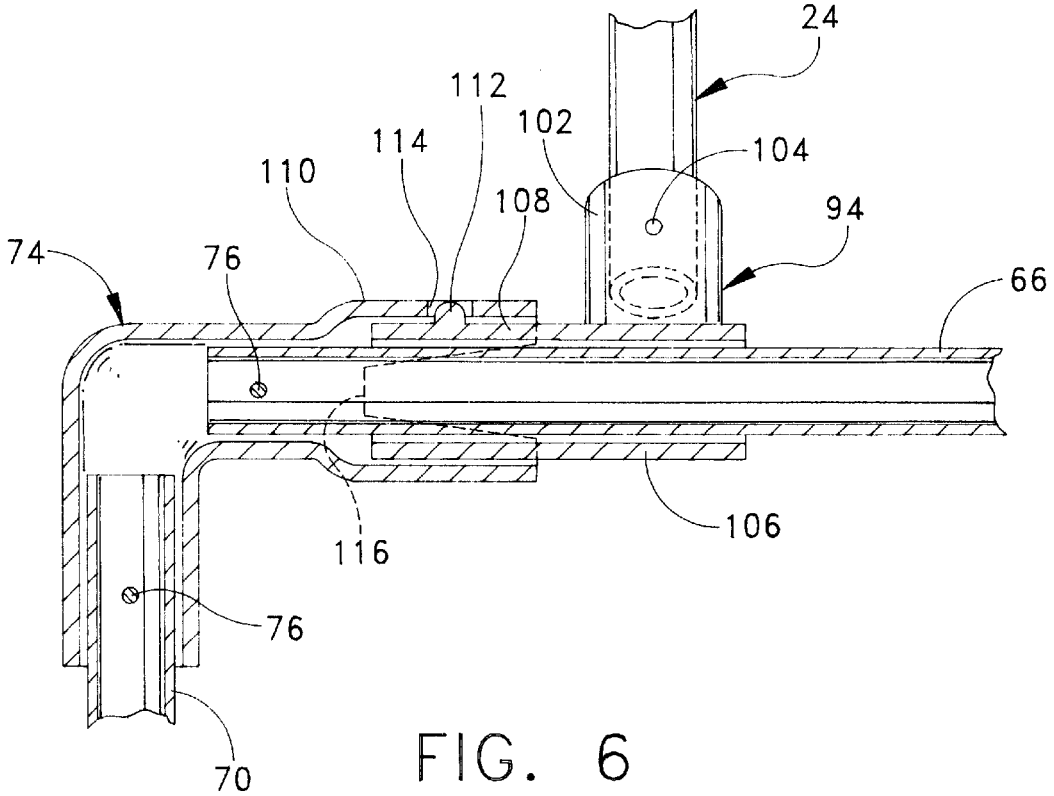
FIG. 6 is a cross-sectional view of one of the connections between the rear frame and a connector rod as taken along line 6—6 of FIG. 2.

The rear frame 20 includes a center frame member 66 and two leg members 68, 70 respectively, which depend downwardly from the center frame member 66. Referring to FIGS. 2 and 6, the upper ends of the leg members 68, 70 are rigidly connected to the center frame member 66 by 90° elbow connectors generally indicated 72, 74 respectively, and threaded fasteners 76. The lower ends of the leg members 68, 70 are pivotally attached to the rear frame member 28 of the base frame 16 by means of T-shaped connectors 78, 80, such that the entire rear frame 20 is pivotally movable relative to the base frame 16. Referring to FIGS. 2 and 4, the center leg 82 of the T-shaped connector 80 is rigidly attached to the lower end of the leg member 70 by a threaded fastener 84 while the cross leg 86 of the connector 80 is slidably and rotatably received around the rear frame member 28 of the base frame 16. It can therefore be seen that the T-shaped connectors 78, 80 are rotatably movable around the rear frame member 28 of the base frame 16 for pivoting movement of the entire rear frame 20 relative to the base frame 16.

The connector rods 22, 24 are pivotally connected at each end thereof between the respective center frame members 44, 66 of the goal frame 18 and the rear frame 20 such that the connector rods 22, 24 are rotatable relative to the goal frame 18 and the rear frame 20. The connector rod 22 has a first end pivotally connected to the center frame member 44 of the goal frame 18 by a T-shaped connector generally indicated 88, and a second end pivotally connected to the center frame member 66 of the rear frame 20 by a T-shaped connector generally indicated 90, such that the connector rod 22 is pivotally rotatable relative to center frame members 44, 66 of the goal frame 18 and the rear frame 20. Likewise, the connector rod 24 has a first end pivotally connected to the center frame member 44 of the goal frame 18 by a T-shaped connector generally indicated 92, and a second end pivotally connected to the center frame member 66 of the rear frame 20 by a T-shaped connector generally indicated 94, such that the connector rod 24 is pivotally rotatable relative to center frame members 44, 66 of the goal frame 18 and the rear frame 20. Referring to FIGS. 2 and 5, the center leg 96 of the T-shaped connector 92 is rigidly secured to the end of the connector rod 24 by means of a threaded fastener 98 while the cross leg 100 of the T-shaped connector 92 is slidably and rotatably received around the center frame members 44 of the goal frame 18. Similarly referring to FIGS. 2 and 6, the center leg 102 of the T-shaped connector 94 is rigidly secured to the opposite end of the connector rod 24 by means of a threaded fastener 104 while the cross leg 106 of the T-shaped connector 94 is slidably and rotatably received around the center frame member 66 of the rear frame 20. The arrangement of the connector rod 22 and T-shaped connectors 88 and 90 is identical.

Figure 7:
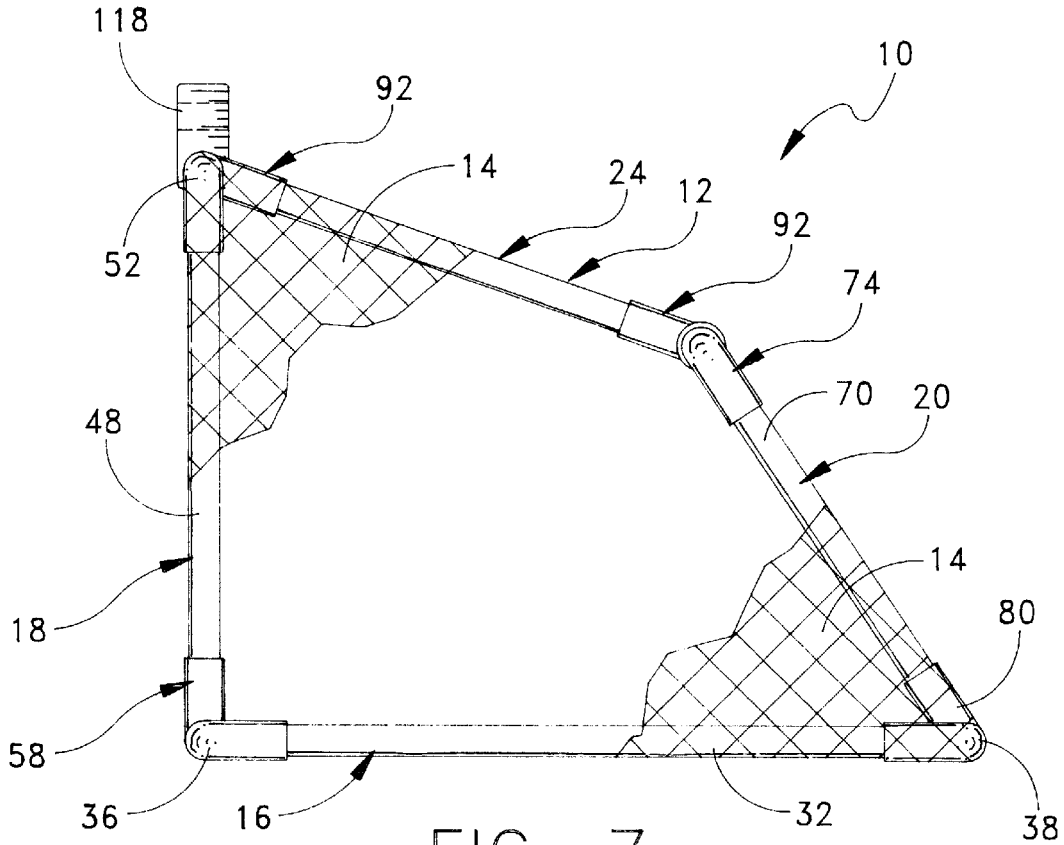
FIG. 7 is a side view of the collapsible sports goal in the fully open position.
Figure 8:
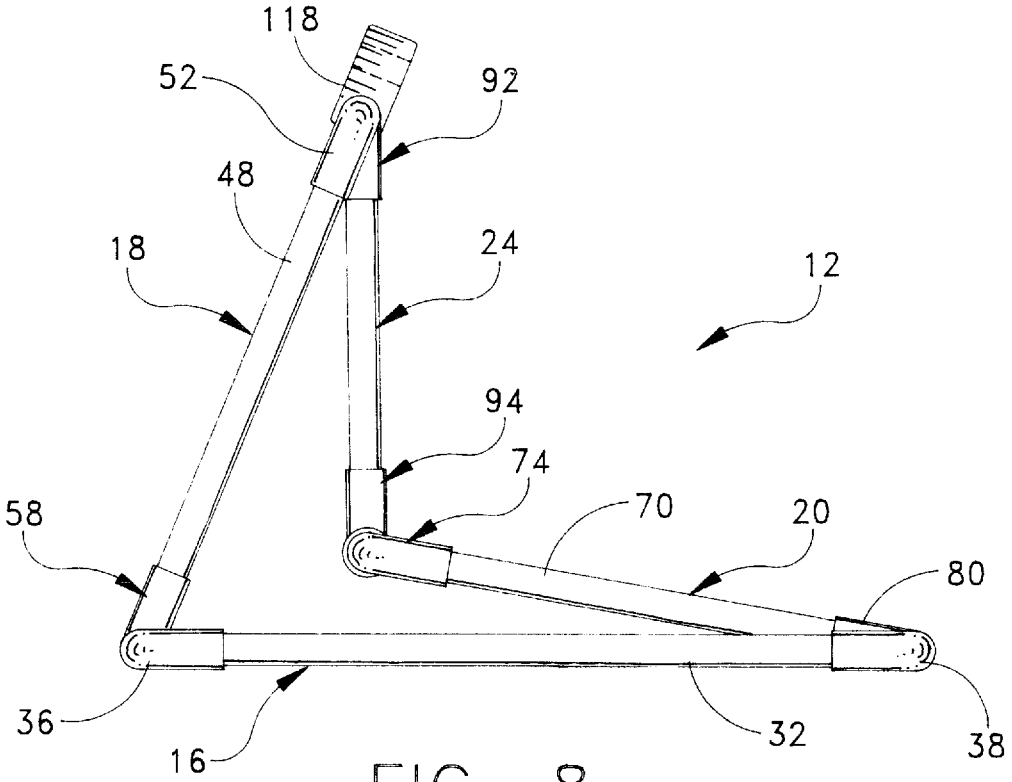
FIG. 8 is a side view thereof with the goal frame, rear frame and connector rods partially collapsed.
Figure 9:
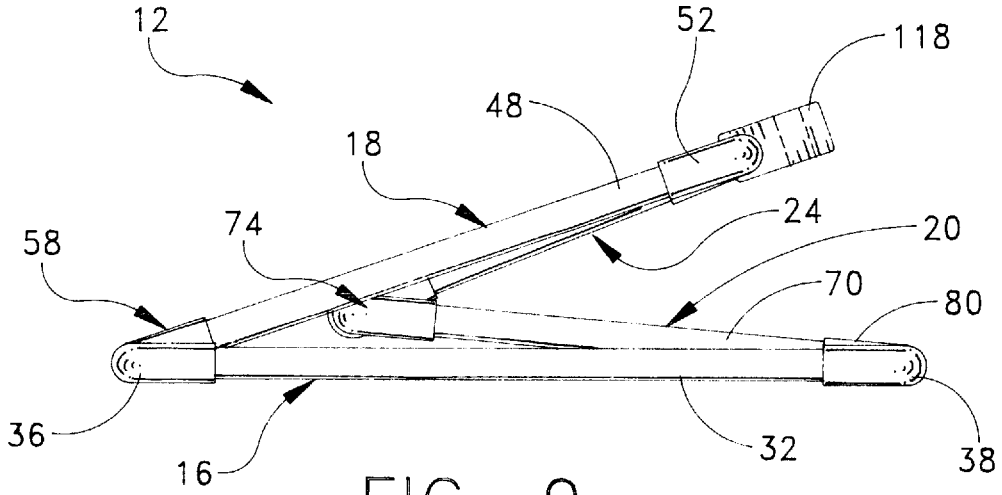
FIG. 9 is a side view thereof with the goal frame, rear frame and connector rods almost completely collapsed.

In use, the frame assembly 12 is movable between an open position (FIGS. 1, 2, and 7), wherein the base frame 16 is positioned in a generally horizontal plane, the goal frame 18 extends vertically upwardly from the base frame 16, the rear frame 20 extends generally upwardly and forwardly, and the connector rods 22, 24 extend laterally between the goal frame 18 and the rear frame 20, and a closed position wherein the goal frame 18, rear frame 20 and connector rods 22, 24 are substantially coplanar with the base frame 16. FIGS. 8 and 9 of the drawings illustrate sequential movement of the frame assembly 12 from the open position (FIG. 7) through two intermediate positions (FIG. 8 and 9) to a fully closed position (not shown). It is pointed out that the goal frame 18 has a width which is less than the width of the base frame 16, and the rear frame 20 has a width which is less than the width of the goal frame 18. It is also pointed out that the connector rods 22, 24 are positioned between the spaced legs 68, 70 of the rear frame 20. In this regard, the goal frame 18, rear frame 20 and connector legs 22, 24 can be pivoted to generally coplanar nested positions within the plane defined by the base frame 16.

In order to releasably lock the frame assembly 12 in the open position, the frame assembly further includes simple interlocking detent and notch formations on the connectors 90, 94 and elbow connectors 72, 74 of the rear frame 20 for releasably locking the frame assembly 12 in the open position. Referring to FIG. 6 again, the outwardly extending end 108 of the cross leg 106 of connector 94 is rotatably received within an enlarged diameter sleeve portion 110 of the elbow connector 74. Accordingly, the cross leg 106 rotates around the center frame member 66 of the rear frame 20 and within the enlarged sleeve 110 of the elbow connector 74. To form the locking mechanism, a detent 112 is provided on the outer surface of the cross leg 108 of the connector 94 while a mating aperture 114 is formed in the enlarged diameter portion 110 of the elbow connector 74. The detent 112 and mating aperture 114 are circumferentially positioned so that they interlock when the frame assembly 12 is positioned in the open position (FIG. 7). Alternatively, when the frame assembly 12 is in the closed position, the detent 112 rests in an open channel 116 formed in the sleeve portion 110 of the elbow connector 74. It is also pointed out the that open channel 116 provides the sleeve 110 with sufficient flexibility to allow the sleeve 110 to deform slightly upon rotation of the detent 112 within the sleeve 110. The arrangement of connector elbow 72 and T-shaped connector 90 is identical.

The frame assembly 12 still further includes a handle member 118 rotatably mounted on the center frame member 44 of the goal frame 18 for carrying the assembly.

Finally, the frame assembly 12 also includes a ramp member 120 rotatably mounted to the front frame member 26 of the base frame 16 for guiding a ball upwardly over the front frame member 26 and into the goal. The ramp 120 includes arcuate spring clips 122 which are snap received around the front frame member 26 of the base frame 16. The spring clips 122 allow rotation of the ramp 120 relative to the front frame member 26.

In an alternate use, the frame assembly 12 can be utilized as a kick back net simply by positioning the assembly 12 with the goal frame 18 on the supporting surface so that the base frame 16 extends vertically upwardly. Since the net 14 extends around the bottom surface of the base frame 16, a vertical netting surface is presented into which a ball can be kicked.

It can therefore be seen that the instant invention provides a highly functional and effective sports goal 10 which can be easily collapsed and opened by small children. The pivoting frame portions 16, 18, 20, 22, 24 are arranged to easily collapse and nest within the base frame 16 so that the entire assembly 12 can be stored and shipped in a flat configuration. Furthermore, the locking mechanisms are easily manipulated, even by small children, for opening and closing the frame assembly 12 for use. The ramp 120 at the front edge of the goal facilitate entry of a ball into the goal 10 over the front frame member 26, and the handle 118 provides an easy means for carrying the goal 10 to a desired location. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A collapsible sport goal comprising:

a frame assembly including a base frame;

an inverted U-shaped goal frame comprising a center portion and two leg portions depending from opposite ends of said center portion, said leg portions each having a terminal end which is pivotally attached to the base frame wherein the goal frame is pivotally movable relative to the base frame;

an inverted U-shaped rear frame comprising a center portion and two leg portions depending from opposite ends of said center portion, said leg members each having a terminal end which is pivotally attached to the base frame wherein the rear frame is pivotally movable relative to the base frame; and at least one connector rod connected between the respective center portions of the goal frame and the rear frame, said at least one connector rod having a first end pivotally connected to the center portion of the goal frame, and a second end pivotally connected to the center portion of the rear frame such that the at least one connector rod is pivotally rotatable relative to center portions of said goal frame and said rear frame, said frame assembly being movable between an open position wherein the goal frame extends vertically, the rear frame extends generally upwardly and forwardly and the at least one connector rod extends between the center portions of the goal frame and the rear frame, and a closed position wherein the goal frame, the rear frame and the at least one connector rod are substantially coplanar with the base frame;

means for releasably locking the frame assembly in the open position; and a net covering at least top, rear and side areas of the frame assembly.

2. The collapsible sport goal of claim 1 wherein said means for releasably locking comprises means for locking rotation the second end of the at least one connector rod relative to the center portion of the rear frame.

3. The collapsible sport goal of claim 2 wherein the second end of the at least one connector rod includes a T-shaped tubular connector having a center leg connected to the second end of the connector rod and a cross leg which is rotatably received around the center portion of the rear frame, said means for locking the second end of the connector rod relative to the center portion of the rear frame comprising interengaging formations respectively formed on the center portion of the rear frame and on the cross leg of the T-shaped connector.

4. The collapsible sport goal of claim 1 wherein said base frame includes a front frame portion, said collapsible sports goal further comprising a ramp attached to the front frame portion of the base frame for guiding the ball over the front frame portion and into the goal.

5. A collapsible sport goal comprising:

a frame assembly including a rectangular base frame having spaced front and rear frame portions;

an inverted U-shaped goal frame comprising a center portion and two leg portions depending from opposite ends of said center portion, said leg portions each having a terminal end which is pivotally attached to the front frame portion of the base frame wherein the goal frame is pivotally movable relative to the front frame portion;

an inverted U-shaped rear frame comprising a center portion and two leg portions depending from opposite ends of said center portion, said leg members each having a terminal end which is pivotally attached to the rear frame portion of the base frame wherein the rear frame is pivotally movable relative to the rear frame portion; and at least one connector rod connected between the respective center portions of the goal frame and the rear frame, said at least one connector rod having a first end pivotally connected to the center portion of the goal frame, and a second end pivotally connected to the center portion of the rear frame such that the at least one connector rod is pivotally rotatable relative to center portions of said goal frame and said rear frame, said frame assembly being movable between an open position wherein the goal frame extends vertically, the rear frame extends generally upwardly and forwardly and the at least one connector rod extends between the center portions of the goal frame and the rear frame, and a closed position wherein the goal frame, the rear frame and the at least one connector rod are substantially coplanar with the base frame;

means for releasably locking the frame assembly in the open position; and a net covering at least top, rear and side areas of the frame assembly.

6. The collapsible sport goal of claim 5 wherein said means for releasably locking comprises means for locking rotation the second end of the at least one connector rod relative to the center portion of the rear frame.

7. The collapsible sport goal of claim 6 wherein the second end of the at least one connector rod includes a T-shaped tubular connector having a center leg connected to the second end of the connector rod and a cross leg which is rotatably received around the center portion of the rear frame, said means for locking the second end of the connector rod relative to the center portion of the rear frame comprising interengaging formations respectively formed on the center portion of the rear frame and on the cross leg of the T-shaped connector.

8. The collapsible sport goal of claim 5 further comprising a ramp attached to the front frame portion of the base frame for guiding the ball over the front frame portion and into the goal.

9. A collapsible sport goal comprising a collapsible frame assembly, and a net extended around the frame assembly such that the net covers at least top, back and side portions of the frame, said collapsible frame assembly comprising a rectangular base frame having spaced front and rear frame portions;

an inverted U-shaped goal frame comprising a center portion and two leg portions depending from opposite ends of said center portion, said leg portions each having a terminal end which is pivotally attached to the front frame portion of the base frame wherein the goal frame is pivotally movable relative to the front frame member between an open position wherein the goal frame is substantially vertical, and a closed position wherein the goal frame is substantially coplanar with the base frame;

an inverted U-shaped rear frame comprising a center portion and two leg portions depending from opposite ends of said center portion, said leg members each having a terminal end which is pivotally attached to the rear frame portion of the base frame wherein the rear frame is pivotally movable relative to the rear frame portion between an open position wherein the rear frame extends generally upwardly and forwardly, and a closed position wherein the rear frame is substantially coplanar with the base frame;

first and second connector rods connected between the respective center portions of the goal frame and the rear frame, each of said connector rods having a first end pivotally connected to the center portion of the goal frame, and a second end pivotally connected to the center portion of the rear frame such that the connector rods are pivotally rotatable relative to center portions of said goal frame and said rear frame, said frame assembly being movable between an open position wherein the goal frame extends vertically, the rear frame extends generally upwardly and forwardly and the connector rods extend laterally between the goal frame and the rear frame, and a closed position wherein the goal frame, rear frame and connector rods are substantially coplanar with the base frame; and means for releasably locking the frame assembly in the open position.

10. The collapsible sport goal of claim 9 wherein said means for locking comprises means for locking rotation the second ends of the connector rods relative to the center portion of the rear frame.

11. The collapsible sport goal of claim 10 wherein the second ends of the connector rods include a T-shaped tubular connector having a center leg connected to the second end of the connector rod and a cross leg which is rotatably received around the center portion of the rear frame, said means for locking the second ends of the connector rods relative to the center portion of the rear frame comprising interengaging formations respectively formed on the center portion of the rear frame and on the cross leg of the T-shaped connector.

12. The collapsible sport goal of claim 9 further comprising a ramp attached to the front frame portion of the base frame for guiding the ball over the front frame portion into the goal.

13. The collapsible sport goal of claim 10 further comprising a ramp attached to the front frame portion of the base frame for guiding the ball over the front frame portion into the goal.

14. The collapsible sport goal of claim 11 further comprising a ramp attached to the front frame portion of the base frame for guiding the ball over the front frame portion into the goal.

* * * * *